US010352130B2

(12) United States Patent
Tolman et al.

(10) Patent No.: US 10,352,130 B2
(45) Date of Patent: Jul. 16, 2019

(54) FLUSHABLE VELOCITY FUSE AND SCREEN ASSEMBLY FOR DOWNHOLE SYSTEMS

(71) Applicants: Randy C. Tolman, Spring, TX (US); Michael C. Romer, The Woodlands, TX (US)

(72) Inventors: Randy C. Tolman, Spring, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 219 days.

(21) Appl. No.: 15/208,699

(22) Filed: Jul. 13, 2016

(65) Prior Publication Data

US 2017/0096877 A1 Apr. 6, 2017

Related U.S. Application Data

(60) Provisional application No. 62/236,538, filed on Oct. 2, 2015.

(51) Int. Cl.

| | |
|---|---|
| ***E21B 34/10*** | (2006.01) |
| ***E21B 43/08*** | (2006.01) |
| ***E21B 43/12*** | (2006.01) |
| ***E21B 43/02*** | (2006.01) |

(52) U.S. Cl.

CPC ..... *E21B 34/10* (2013.01); *E21B 43/02* (2013.01); *E21B 43/08* (2013.01); *E21B 43/121* (2013.01)

(58) Field of Classification Search

CPC ..... E21B 37/08; E21B 43/08–088

See application file for complete search history.

(56) References Cited

U.S. PATENT DOCUMENTS

| | | | | |
|---|---|---|---|---|
| 2,874,784 | A * | 2/1959 | Baker | E21B 23/04 166/212 |
| 3,741,300 | A * | 6/1973 | Wolff | E21B 43/02 166/184 |
| 4,969,518 | A * | 11/1990 | Schmitt | F04B 47/02 166/228 |
| 5,413,721 | A * | 5/1995 | Schmitt | B01D 29/15 210/747.1 |
| 5,494,109 | A * | 2/1996 | Schmitt | B01D 29/114 166/312 |
| 2004/0055749 | A1* | 3/2004 | Lonnes | E21B 23/04 166/298 |
| 2006/0164256 | A1* | 7/2006 | Hudson | E21B 34/066 340/853.1 |
| 2009/0078428 | A1* | 3/2009 | Ali | E21B 34/08 166/373 |
| 2011/0198080 | A1* | 8/2011 | Demong | E21B 21/063 166/267 |

* cited by examiner

*Primary Examiner* — William D Hutton, Jr.
*Assistant Examiner* — Steven A Macdonald
(74) *Attorney, Agent, or Firm* — ExxonMobil Upstream Research Company—Law Department

(57) ABSTRACT

A flushable well screen or filter assembly for placement within a tubular. The assembly includes a well screen or filter having an inlet end and an outlet end; and a velocity fuse positioned downstream of the outlet end of the well screen or filter, the velocity fuse in fluid communication with the well screen or filter. A system for removing fluids from a well and a method for back-flushing an upstream well screen or filter installed within a tubular are also provided.

38 Claims, 4 Drawing Sheets

FLUSHABLE VELOCITY FUSE AND SCREEN ASSEMBLY FOR DOWNHOLE SYSTEMS

CROSS REFERENCE TO RELATED APPLICATION

This application claims the benefit of U.S. Provisional Patent Application No. 62/236,538, filed Oct. 2, 2015, entitled "Flushable Velocity Fuse And Screen Assembly For Downhole Systems," the entirety of which is incorporated by reference herein.

FIELD

The present disclosure relates to systems and methods for conditioning downhole fluids.

BACKGROUND

When first completed, many gas wells have sufficient reservoir pressure to flow formation fluids to the surface along with the produced gas. As gas production continues, the reservoir pressure declines, and as pressure declines, the velocity of the fluid in the well tubing decreases. Eventually, the gas velocity up the production tubing is no longer sufficient to lift liquid droplets to the surface. Liquids may then accumulate in the tubing, creating additional pressure drop, slowing gas velocity, and raising pressure in the reservoir surrounding the well perforations and inside the casing. As the bottom well pressure approaches reservoir shut-in pressure, gas flow may stop and liquids can accumulate at the bottom of the tubing.

At different stages in the life of a gas well, various means can be employed to move accumulated liquids to the surface. These may include foaming agents or surfactants, velocity tubing, plunger lift, and downhole pumps. The proper application of pumps can lower the abandonment pressure of wells, increasing reserves captured per well, and reduce the number of wells required to economically deplete an asset.

Micro positive displacement and solid state pumps are currently being developed for installation in field applications. Given the nature of these pumps and their valving, filtering of the intake fluid may be required. As such, the potential for plugging screens and/or filters can be a concern. In some configurations, screen and filter cleaning or replacement may be costly, since the complete removal of the deployment cable and pump may be required.

Therefore, what are needed are improved systems and methods for maintaining downhole pumps and cleaning the upstream filters and screens of downhole pump-based systems.

SUMMARY

In one aspect, disclosed herein is a flushable well screen or filter assembly for placement within a tubular. The assembly includes a well screen or filter having an inlet end and an outlet end; and a velocity fuse positioned downstream of the outlet end of the well screen or filter, the velocity fuse in fluid communication with the well screen or filter.

In some embodiments, the assembly further includes a housing, the velocity fuse positioned within the housing.

In some embodiments, the housing comprises an inlet end and an outlet end, the inlet end attached to the outlet end of the well screen or filter.

In some embodiments, the housing is structured and arranged for sealingly engaging the tubular.

In some embodiments, the housing comprises at least one seal, the housing configured to seat within a tubular.

In some embodiments, the housing further comprises a pressure sensor to monitor upstream screen or filter plugging.

In some embodiments, the pressure data from the pressure sensor is used to determine when the well screen or filter will be flushed.

In some embodiments, the velocity fuse is normally open and comprises a spring-loaded poppet responsive to changes in pressure drop across the velocity fuse.

In some embodiments, the velocity fuse may be adjusted to a predetermined flow velocity set-point for closure.

In another aspect, disclosed herein is a system for removing fluids from a well. The system includes a pump having an inlet end and a discharge end; a driver operatively connected to the pump for driving the pump; a well screen or filter in fluid communication with the inlet end of the pump, the well screen or filter having an inlet end and an outlet end; and a velocity fuse positioned between the outlet end of the well screen or filter and the inlet end of the pump.

In some embodiments, the system is contained within a tubular.

In some embodiments, the velocity fuse is structured and arranged to back-flush the well screen or filter and maintain a column of fluid within the tubular in response to an increase in pressure drop across the velocity fuse.

In some embodiments, the velocity fuse is normally open and comprises a spring-loaded poppet responsive to changes in pressure drop across the velocity fuse.

In some embodiments, the system further includes a housing, the velocity fuse positioned within the housing.

In some embodiments, the housing comprises at least one seal and is structured and arranged to seat within a tubular.

In some embodiments, the housing has an inlet end and an outlet end, the inlet end attached to the outlet end of the well screen or filter.

In some embodiments, the housing further comprises a pressure sensor to monitor upstream screen or filter plugging.

In some embodiments, pressure data from the pressure sensor is communicated to the surface via cable or wirelessly and used to determine when the well screen or filter will be back-flushed.

In some embodiments, the velocity fuse may be adjusted to a predetermined flow velocity set-point for closure.

In yet another aspect, disclosed herein is a method for back-flushing an upstream well screen or filter installed within a tubular. The method includes removing a tubular hydraulic seal downstream of a normally-open velocity fuse; providing a differential pressure across the velocity fuse to create a high-velocity stream of fluid to back-flush the upstream well screen or filter; removing debris from the upstream well screen or filter; closing the velocity fuse using the high-velocity fluid stream; and re-installing the tubular hydraulic seal upon closure of the velocity fuse.

In some embodiments, the method further includes repeating steps to obtain or maintain an acceptable pressure drop across the well screen or filter.

In some embodiments, the velocity fuse is structured and arranged to maintain a column of fluid within the tubular in response to an increase in pressure drop across the velocity fuse.

In some embodiments, the velocity fuse comprises a spring-loaded poppet responsive to changes in pressure drop across the velocity fuse.

In some embodiments, the method further includes positioning the velocity fuse within a housing.

In some embodiments, the method further includes sealing the housing within the tubular.

In some embodiments, the housing has an inlet end and an outlet end, the inlet end attached to the outlet end of the well screen.

In some embodiments, the method further includes installing a pressure sensor within the housing to monitor upstream screen or filter plugging.

In some embodiments, the method further includes monitoring pressure data from the pressure sensor to determine when the well screen will be back-flushed.

In some embodiments, the method further includes adjusting the velocity fuse to a predetermined flow velocity set-point.

In still yet another aspect, disclosed herein is a wellbore. The wellbore includes a borehole extending into an earth formation; a tubular extending into the borehole; and a flushable well screen or filter assembly for placement within the tubular, which includes a well screen or filter having an inlet end and an outlet end; and a velocity fuse positioned downstream of the outlet end of the well screen or filter, the velocity fuse in fluid communication with the well screen or filter.

In a further aspect, disclosed herein is a method of forming a completion system within a wellbore. The method includes installing a tubular within a borehole, installing a pump within the tubular, the pump having an inlet end and a discharge end and a driver operatively connected to the pump for driving the pump; and installing a flushable well screen or filter assembly for placement within the tubular, which includes a well screen or filter having an inlet end and an outlet end; and a velocity fuse positioned downstream of the outlet end of the well screen or filter, the velocity fuse in fluid communication with the well screen or filter.

In some embodiments, the method further includes installing one or more packers to isolate one or more production zones within the wellbore.

In a still further aspect, disclosed herein is a method of producing hydrocarbons from a subterranean formation. The method includes providing a borehole extending into a hydrocarbon-bearing zone of the formation; installing a tubular into the borehole; installing a flushable well screen or filter assembly for placement within the tubular, which includes a well screen or filter having an inlet end and an outlet end; and a velocity fuse positioned downstream of the outlet end of the well screen or filter, the velocity fuse in fluid communication with the well screen or filter; and producing a fluid including hydrocarbons.

DETAILED DESCRIPTION

In FIGS. 1-4, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

FIGS. 1-4 provide illustrative, non-exclusive examples of assemblies, systems and methods for removing fluids from a well, according to the present disclosure, together with elements that may include, be associated with, be operatively attached to, and/or utilize such assemblies, systems and methods.

Although the approach disclosed herein can be applied to a variety of subterranean well designs and operations, the present description will primarily be directed to systems for removing fluids from a well.

Figure 1:
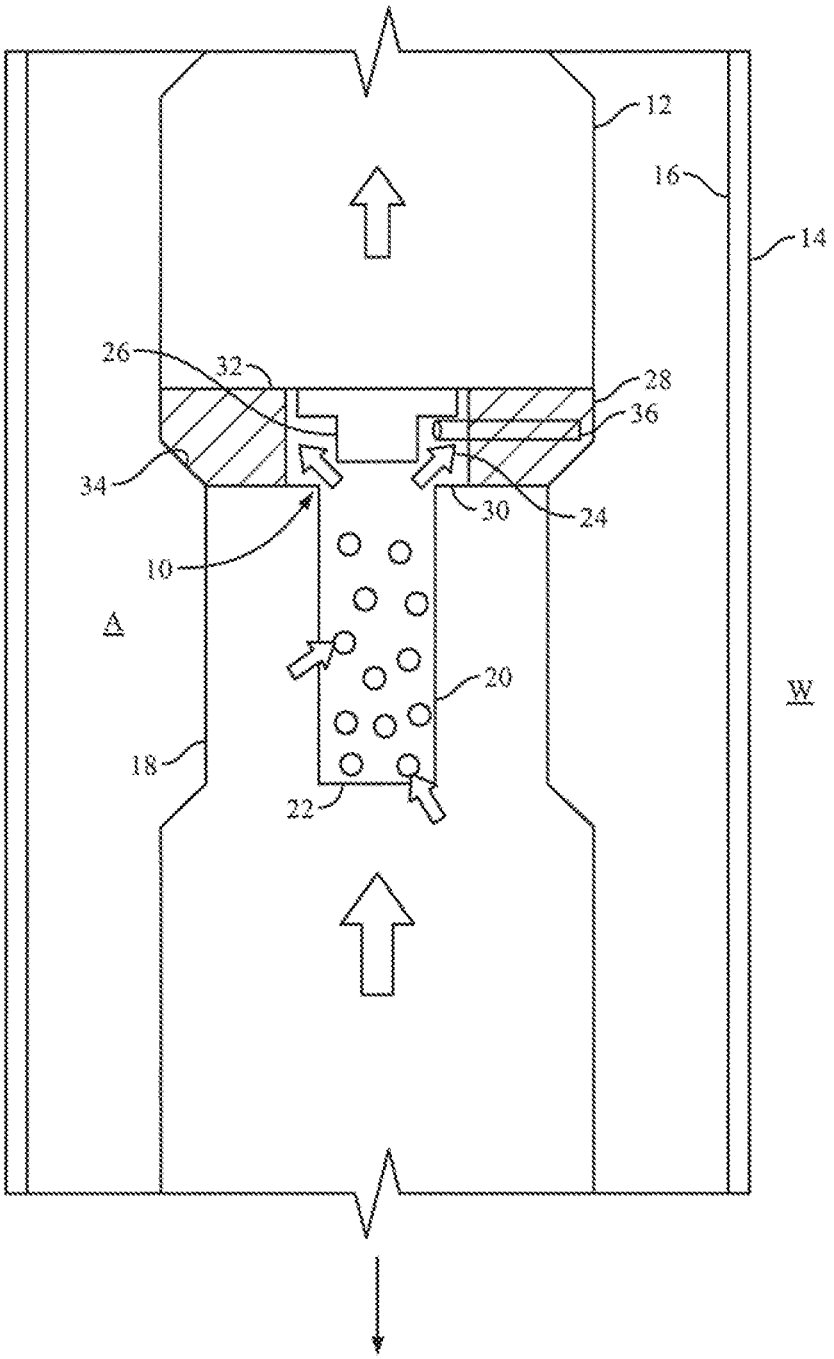
FIG. 1 presents a schematic view of an illustrative, nonexclusive example of a flushable well screen or filter assembly for placement within a tubular, according to the present disclosure.

FIG. 1 presents, for illustrative purposes, a schematic view of a flushable well screen or filter assembly 10 for placement within a tubular 12. As shown, the tubular 12 may reside within a casing 14 of a subterranean well W. The interior surface 16 of the casing 14 and the exterior surface 18 of the tubing 12 serve to define an annular space A.

The flushable well screen or filter assembly 10, as disclosed herein, includes a well screen or filter 20 having an inlet end 22 and an outlet end 24. Assembly 10 also includes a velocity fuse 26 positioned downstream of the outlet end 24 of the well screen or filter 20. As shown, the velocity fuse 26 is in fluid communication with the well screen or filter 20.

In some embodiments, the assembly 10 includes a housing 28, the velocity fuse 26 positioned within the housing 28. The housing 28 includes an inlet end 30 and an outlet end 32, the inlet end 30 attached to the outlet end 24 of the well screen or filter 20.

In some embodiments, the housing 28 is structured and arranged for sealingly engaging the tubular 12. In some embodiments, the housing 28 comprises at least one seal 34. In some embodiments, the housing 28 may be configured to seat within a tubular 12, as shown.

In some embodiments, the housing 28 may also include a pressure sensor 36 to monitor upstream screen or filter plugging. Pressure data from the pressure sensor 36 may be used to determine when the well screen or filter 20 is in need of flushing.

In some embodiments, the assembly may employ a fishable or retrievable housing, with the screen or filter attached to the bottom of the housing such that it can be recovered on the same trip if desired. This may necessitate specifying a diameter and conduit that would minimize free gas interference. The conduit would be attached to the screen on one end and the housing of the velocity fuse on the other.

Figure 2:
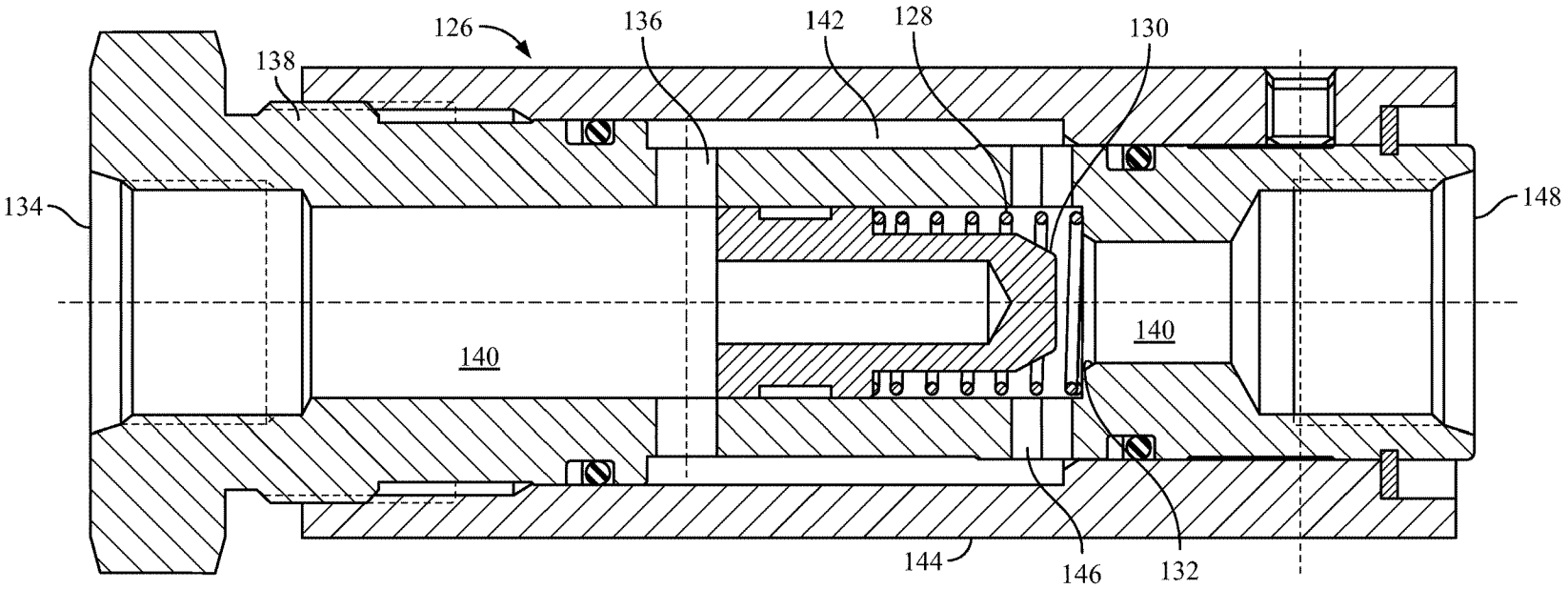
FIG. 2 presents a cross-sectional view of an illustrative, nonexclusive example of a velocity fuse having utility in the flushable well screen or filter assemblies of the present disclosure.

Referring now to FIG. 2, a cross-sectional view of an illustrative, nonexclusive example of a velocity fuse 126 having utility in the flushable well screen or filter assemblies of the present disclosure.

In some embodiments, the velocity fuse 126 is an adjustable velocity fuse, which may be configured to be a normally open, in-line valve. Under normal operating conditions, a spring 128 holds the velocity fuse poppet 130 off a poppet seat 132.

Flow enters the velocity fuse 126 at a flanged inlet port 134. Before reaching the velocity fuse poppet 130, a series of radial holes 136 in body 138 directs flow from body core 140 into an annular cavity 142 between the body 138 and an adjusting sleeve 144. Flow is directed axially between the body 138 and adjusting sleeve 144 until it reaches another series of radial holes 146 at the poppet seat 132. Flow is then directed back into the body core 140 through the poppet seat 132 and out the fuse outlet port 148.

In some embodiments, external adjustments of the adjusting sleeve 144 may be made to reduce the free area of the radial holes 146. This reduction in area creates an increase in flow velocity, resulting in a higher pressure drop. When the pressure drop exceeds the spring force K holding the velocity fuse poppet 130 open, the inlet pressure will force the velocity fuse poppet 130 against the poppet seat 132, effectively closing the velocity fuse 126.

The velocity fuse 126 can be adjusted such that, at normal flows, the velocity fuse 126 will remain open but increased flow rates, such as caused by downstream line rupture, will result in a rapid closing of the velocity fuse 126. The velocity fuse 126 will remain closed until the inlet pressure is eliminated or the downstream pressure is equalized with the inlet.

In some embodiments, the velocity fuse 126 is normally open and comprises a spring-loaded velocity fuse poppet 130 responsive to changes in pressure drop across the velocity fuse 126. In some embodiments, the velocity fuse 126 may be adjusted to a predetermined flow velocity set-point for closure.

Suitable velocity fuses are commercially available from a variety of sources, including the Hydraulic Valve Division of Parker Hannifin Corporation, Elyria, Ohio, USA, and Vonberg Valve, Inc., Rolling Meadows, Ill., USA. In particular, two sizes of commercially available velocity fuses are expected to have utility in the practice of the present disclosure. These are: a velocity fuse having a 1" OD, with a flow range of 11 liters/minute (3 GPM) to 102 liters/minute (27 GPM), and a velocity of having a 1.5" OD, with a flow range of: 23 liters/minute (6 GPM) to 227 liters/minute (60 GPM). Each of these commercially available velocity sleeves have a maximum working pressure of 5,000 psi and a temperature ratings of −20 F to +350 F (−27 C to +177 C). The body and sleeve are made of brass, and the poppet, roll pin, and spring are made of stainless steel. O-rings are both nitrile and PTFE. Custom-built velocity fuses are envisioned and may provide a higher pressure rated device, if needed, which may be incorporated into a housing for seating in the no-go profile nipple.

Figure 3:
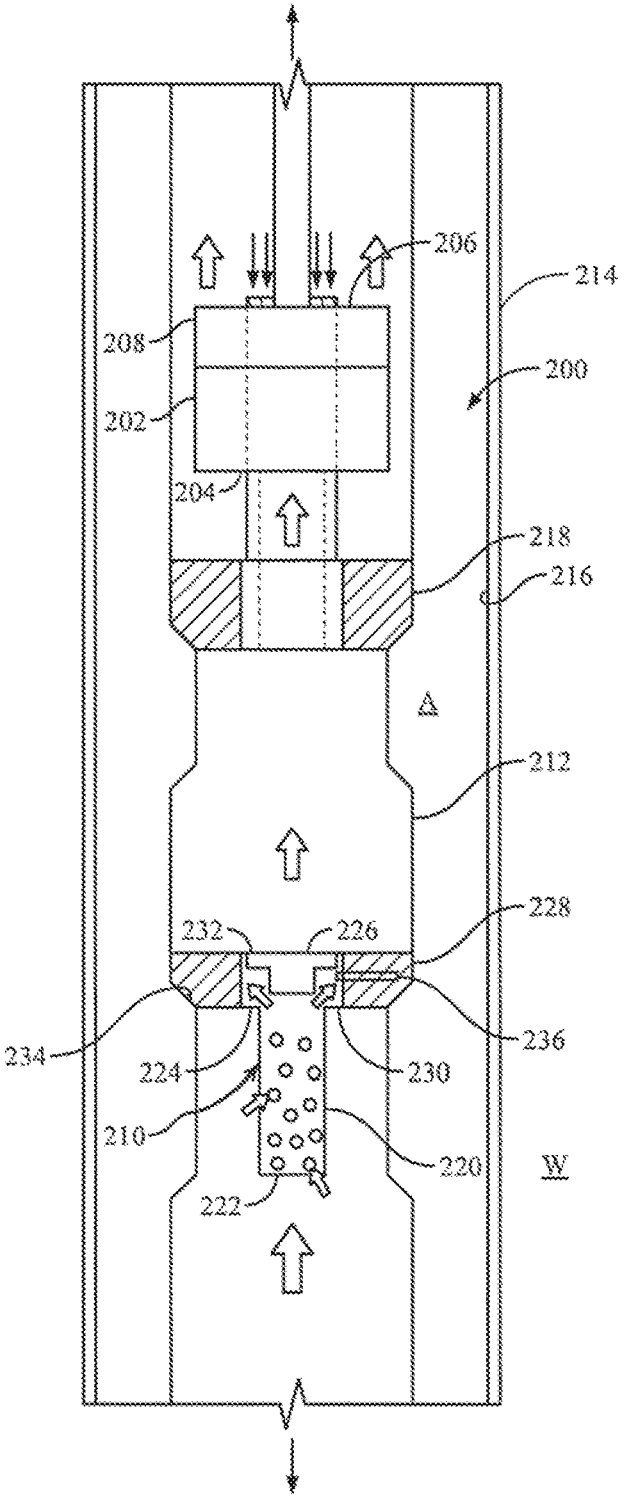
FIG. 3 presents a schematic view of an illustrative, nonexclusive example of a system for removing fluids from a well, according to the present disclosure.

Referring now to FIG. 3, a system 200 for removing fluids from a well, according to the present disclosure, is shown. As shown, in some embodiments, a subterranean well W, may include a tubular 212 placed within a casing 214. The interior surface 216 of the casing 214 and the exterior surface 218 of the tubing 212 serve to define an annular space A.

The system 200 includes a pump 202 having an inlet end 204 and a discharge end 206. The system 200 also includes a driver 208 operatively connected to the pump 202 for driving the pump 202.

Upstream of the pump 202 and driver 208, is a flushable well screen or filter assembly 210. The flushable well screen or filter assembly 210 includes a well screen or filter 220 having an inlet end 222 and an outlet end 224. Assembly 210 also includes a velocity fuse 226 positioned downstream of the outlet end 224 of the well screen or filter 220. As shown, the velocity fuse 226 is in fluid communication with the well screen or filter 220.

In some embodiments, the assembly 210 includes a housing 228, the velocity fuse 226 positioned within the housing 228. The housing 228 includes an inlet end 230 and an outlet end 232, the inlet end 230 attached to the outlet end 224 of the well screen or filter 220.

In some embodiments, the housing 228 is structured and arranged for sealingly engaging the tubular 212. In some embodiments, the housing 228 comprises at least one seal 234. In some embodiments, the housing 228 may be configured to seat within a tubular 212, as shown.

In some embodiments, the housing 228 may also include a pressure sensor 236 to monitor upstream screen or filter plugging. Pressure data from the pressure sensor 236 may be used to determine when the well screen or filter 220 is in need of flushing.

As disclosed herein, the velocity fuse 226 is structured and arranged to back-flush the well screen or filter 220 and maintain a column of fluid within the tubular 212 in response to an increase in pressure drop across the velocity fuse 236. As described hereinabove, the velocity fuse 226 is normally open and comprises a spring-loaded poppet responsive to changes in pressure drop across the velocity fuse 226. The velocity fuse 226 may be adjusted to a predetermined flow velocity set-point for closure. (See FIG. 2).

The assemblies, systems and methods disclosed herein achieve the benefits of a standing valve for holding a column of fluid in the tubing, when needed, and overcomes the limitations of not being able to clean a lower screen or filter without complete removal of the pump and standing valve. The velocity fuses disclosed herein are specifically engineered to allow fluid flow though the valve or fuse until sufficient pressure drop across the fuse actuates it into the closed position. While in the closed position the velocity fuse is capable of holding the entire fluid column, in the manner in which a standing valve would. Once pumping is resumed, the pressure differential across the velocity fuse permits it to open and flow then reaches the pump as with a standing valve.

In operation, during an initial surge of fluid from unseating the pump using the wireline, several barrels of fluid at high rate will reverse flow across the screen or filter, dislodging debris. This instantaneous fluid pulse would cause the velocity fuse to close. The wireline operator could then reseat the pump within the profile nipple having only lifted it a few feet in the well. Shutting in the well for a few hours after reseating the pump would allow loose solids from the backflush operation to settle into the bottom of the well. This serves to prevent those solids from ever contacting the screen again, as well as prevent their over-displacement into the formation via perforation tunnels or the like.

In some embodiments, the assembly may be built into a wireline assembly and retrievable housing. Alternatively, the assembly may be run in place in the tubing string during installation and recovered via wireline or upon pulling the tubing to the surface.

Figure 4:
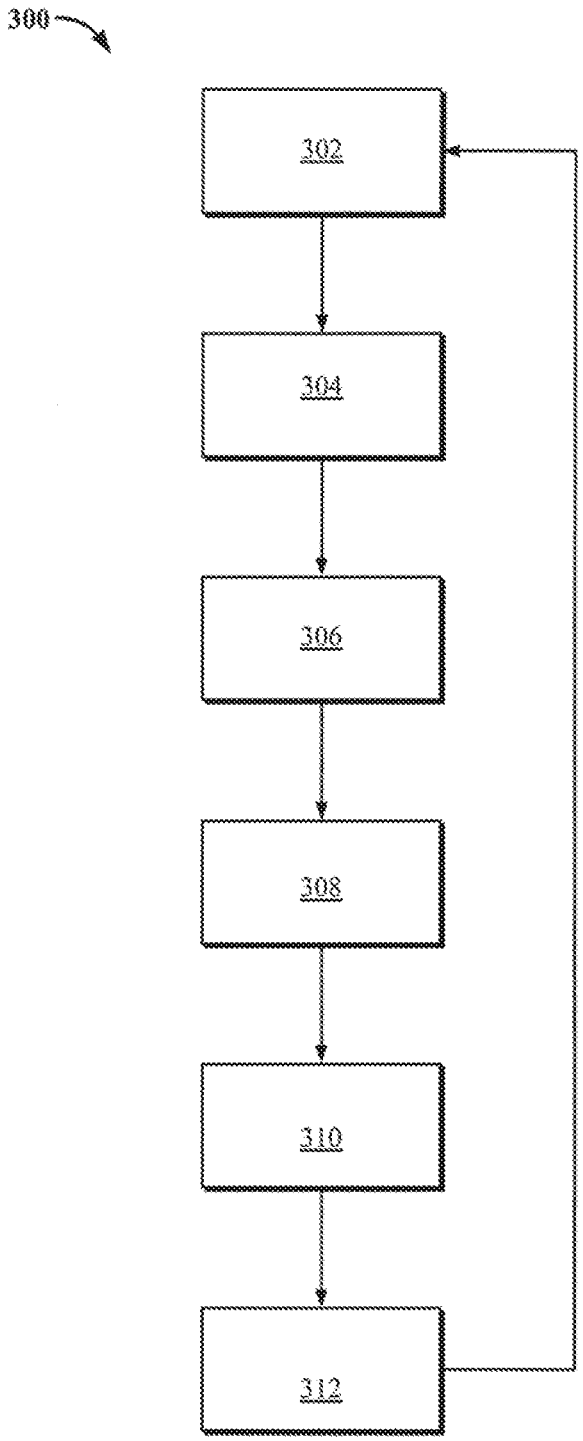
FIG. 4 presents a method for back-flushing an upstream well screen or filter installed within a tubular, according to the present disclosure.

Referring to FIG. 4, in another aspect, provided is a method 300 for back-flushing an upstream well screen or filter installed within a tubular. The method includes 302, removing a tubular hydraulic seal downstream of a normally-open velocity fuse; 304, providing a differential pressure across the velocity fuse to create a high-velocity stream of fluid to back-flush the upstream well screen or filter; 306, removing debris from the upstream well screen or filter; 308, closing the velocity fuse using the high-velocity fluid stream; and 310, re-installing the tubular hydraulic seal upon closure of the velocity fuse.

In some embodiments, the method includes 312, repeating steps 302 through 310 to obtain or maintain an acceptable pressure drop across the well screen or filter.

In some embodiments, the velocity fuse is structured and arranged to maintain a column of fluid within the tubular in response to an increase in pressure drop across the velocity fuse. In some embodiments, the velocity fuse comprises a spring-loaded poppet responsive to changes in pressure drop across the velocity fuse. In some embodiments, the method includes adjusting the velocity fuse to a predetermined flow velocity set-point.

In some embodiments, the method includes positioning the velocity fuse within a housing. In some embodiments, the method includes sealing the housing within the tubular. In some embodiments, the housing has an inlet end and an outlet end, the inlet end attached to the outlet end of the well screen.

In some embodiments, the method includes installing a pressure sensor within the housing to monitor upstream screen or filter plugging. In some embodiments, the method includes monitoring pressure data from the pressure sensor to determine when the well screen will be back-flushed.

In another aspect, disclosed herein is a wellbore. The wellbore includes a borehole extending into an earth formation; a tubular extending into the borehole; and a flushable well screen or filter assembly for placement within the tubular, which includes a well screen or filter having an inlet end and an outlet end; and a velocity fuse positioned downstream of the outlet end of the well screen or filter, the velocity fuse in fluid communication with the well screen or filter.

In a further aspect, disclosed herein is a method of forming a completion system within a wellbore. The method includes installing a tubular within a borehole, installing a pump within the tubular, the pump having an inlet end and a discharge end and a driver operatively connected to the pump for driving the pump; and installing a flushable well screen or filter assembly for placement within the tubular, which includes a well screen or filter having an inlet end and an outlet end; and a velocity fuse positioned downstream of the outlet end of the well screen or filter, the velocity fuse in fluid communication with the well screen or filter.

In some embodiments, the method further includes installing one or more packers to isolate one or more production zones within the wellbore.

In a still further aspect, disclosed herein is a method of producing hydrocarbons from a subterranean formation. The method includes providing a borehole extending into a hydrocarbon-bearing zone of the formation; installing a tubular into the borehole; installing a flushable well screen or filter assembly for placement within the tubular, which includes a well screen or filter having an inlet end and an outlet end; and a velocity fuse positioned downstream of the outlet end of the well screen or filter, the velocity fuse in fluid communication with the well screen or filter; and producing a fluid including hydrocarbons.

In some embodiments, the method further includes the step of back-flushing the well screen or filter.

In some embodiments, the step of back-flushing the well screen or filter includes a) removing a tubular hydraulic seal downstream of the velocity fuse; b) providing a differential pressure across the velocity fuse to create a high-velocity stream of fluid to back-flush the well screen or filter; c) removing debris from the well screen or filter; d) closing the velocity fuse using the high-velocity fluid stream; and e) re-installing the tubular hydraulic seal upon closure of the velocity fuse.

In some embodiments, the method further includes repeating steps a through e to obtain or maintain an acceptable pressure drop across the well screen or filter.

In some embodiments, the velocity fuse is structured and arranged to maintain a column of fluid within the tubular in response to an increase in pressure drop across the velocity fuse.

In some embodiments, the velocity fuse includes a spring-loaded poppet responsive to changes in pressure drop across the velocity fuse.

In some embodiments, the method further includes installing a pressure sensor to monitor upstream screen or filter plugging.

In some embodiments, the method further includes the monitoring of pressure data from the pressure sensor to determine when the well screen will be back-flushed.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein may additionally or alternatively be referred to as a "step for" performing the recited action.

Illustrative, non-exclusive examples of assemblies, systems and methods according to the present disclosure have been presented. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A flushable well screen or filter assembly for placement within a tubular, comprising:

a) a well screen or filter in fluid communication with the tubular, the well screen or filter having an inlet end and an outlet end, the well screen or filter filtering a fluid stream normally flowing through the tubular;

b) a velocity fuse positioned within the tubular downstream of the outlet end of the well screen or filter, the velocity fuse in fluid communication with the well screen or filter, the velocity fuse positioned normally open to permit normal fluid flow from the outlet end of the well screen or filter, through the velocity fuse and to within the tubular; and c) an adjustable poppet valve within the velocity fuse adjusted to allow a backflow of fluid through the velocity fuse toward the well screen or filter to backflush the well screen or filter until the well screen or filter is flushed resulting in a backflow fluid pressure drop across the screen that is less than a backflow fluid pressure drop across the velocity fuse, wherein an increased backflow fluid pressure drop across the velocity fuse closes the backflow of fluid past the velocity fuse and maintains a column of fluid within the tubular.

2. The assembly of claim 1, further comprising a housing, the velocity fuse positioned within the housing.

3. The assembly of claim 2, wherein the housing comprises an inlet end and an outlet end, the inlet end attached to the outlet end of the well screen or filter.

4. The assembly of claim 3, wherein the housing is structured and arranged for sealingly engaging the tubular.

5. The assembly of claim 4, wherein the housing comprises at least one seal, the housing configured to seat within the tubular.

6. The assembly of claim 5, wherein the housing further comprises a pressure sensor to monitor upstream screen or filter plugging.

7. The assembly of claim 1, wherein the housing further comprises a pressure sensor to monitor upstream screen or filter plugging.

8. The assembly of claim 7, wherein pressure data from the pressure sensor is used to determine when the well screen or filter will be flushed.

9. The assembly of claim 1, wherein the velocity fuse is normally open and comprises a spring-loaded poppet responsive to changes in pressure drop across the velocity fuse.

10. The assembly of claim 1, wherein the velocity fuse may be adjusted to a predetermined flow velocity set-point for closure.

11. A system for removing fluid from a well, the system comprising:

a) a pump having an inlet end and a discharge end, the pump positioned within a tubular positioned within the well;

b) a driver operatively connected to the pump for driving the pump;

c) a well screen or filter in fluid communication with the inlet end of the pump, the well screen or filter having an inlet end and an outlet end; and d) a velocity fuse positioned between the outlet end of the well screen or filter and the inlet end of the pump, wherein the velocity fuse is structured and arranged to back-flush the well screen or filter and maintain a column of fluid within the tubular in response to an increase in pressure drop across the velocity fuse.

12. The system of claim 11, wherein the system is contained within a tubular.

13. The system of claim 11, wherein the velocity fuse is normally open and comprises a spring-loaded poppet responsive to changes in pressure drop across the velocity fuse.

14. The system of claim 13, further comprising a housing, the velocity fuse positioned within the housing.

15. The system of claim 14, wherein the housing further comprises a pressure sensor to monitor upstream screen or filter plugging.

16. The system of claim 15, wherein pressure data from the pressure sensor is communicated to the surface via cable or wirelessly and used to determine when the well screen or filter will be back-flushed.

17. The system of claim 11, wherein the velocity fuse may be adjusted to a predetermined flow velocity set-point for closure.

18. A method for back-flushing an upstream well screen or filter installed within a tubular, comprising:

providing within a well;

(i) the tubular;

(ii) a pump seated and hydraulically sealed within the tubular, the pump having an inlet end and a discharge end and a driver operatively connected to the pump for driving the pump;

(iii) a well screen or filter positioned in fluid communication with the tubular, the well screen or filter having an inlet end and an outlet end, the well screen or filter filtering a fluid stream normally flowing through the well screen or filter to the pump;

(iv) a normally-open velocity fuse in fluid communication with the tubular and with the outlet end of the well screen or filter and positioned upstream of the inlet end of the pump and normally open to permit normal fluid flow from the outlet end of the well screen or filter, past the velocity fuse and to the pump; and (v) an adjustable poppet valve within the velocity fuse adjusted to enable both (a) a normal flow of fluid from the filter, through the velocity fuse, across the poppet valve, and to the pump to provide a substantially continuous flow of fluid through the velocity fuse during normal pumping operation through the tubular, and (b) a backflow of fluid through the velocity fuse, across the poppet valve and toward the well screen or filter to back-flush the well screen or filter until the well screen or filter is flushed resulting in a decreased backflow fluid pressure drop across the screen or filter that is less than a backflow fluid pressure drop across the velocity fuse, wherein an increased backflow fluid pressure drop across the velocity fuse closes the velocity fuse and maintain a column of fluid within the tubular;

unseating the pump to remove the hydraulic seal between the pump and the tubing downstream of the normally-open velocity fuse to back-flush the well screen or filter;

allowing the backflow of fluid to flush the well screen or filter until the backflow of fluid stops flowing due to closure of the velocity fuse;

and thereafter, reseating the pump to form the hydraulic seal with the tubular.

19. The method of claim 18, wherein the velocity fuse comprises a spring-loaded poppet responsive to changes in pressure drop across the velocity fuse.

20. The method of claim 18, further comprising positioning the velocity fuse within a housing.

21. The method of claim 20, further comprising sealing the housing within the tubular.

22. The method of claim 21, further comprising installing a pressure sensor within the housing to monitor upstream screen or filter plugging.

23. The method of claim 22, further comprising monitoring pressure data from the pressure sensor to determine when the well screen will be back-flushed.

24. The method of claim 18, further comprising adjusting the velocity fuse to a predetermined flow velocity set-point.

25. A wellbore comprising:

a borehole extending into an earth formation;

a tubular extending into the borehole;

a flushable well screen or filter in fluid communication with the tubular, comprising the well screen or filter having an inlet end and an outlet end, the well screen or filter filtering a fluid stream normally flowing through the tubular;

a velocity fuse positioned within the tubular downstream of the outlet end of the well screen or filter, the velocity fuse in fluid communication with the well screen or filter, the velocity fuse positioned normally open to permit normal fluid flow from the outlet end of the well screen or filter, past the velocity fuse to within the tubular; and an adjustable poppet valve within the velocity fuse adjusted to allow a backflow of fluid to flow through the velocity fuse, past the poppet valve, toward the screen or filter to back-flush the well screen or filter until the well screen or filter is flushed resulting in a a backflow fluid pressure drop across the screen that is less than a backflow fluid pressure drop across the velocity fuse, wherein an increased backflow fluid pressure drop across the velocity fuse closes the backflow of fluid past velocity fuse and maintains a standing column of fluid within the tubular.

26. The wellbore of claim 25, further comprising a housing, the velocity fuse positioned within the housing.

27. The wellbore of claim 26, wherein the housing comprises an inlet end and an outlet end, the inlet end attached to the outlet end of the well screen or filter.

28. The wellbore of claim 27, wherein the housing is structured and arranged for sealingly engaging the tubular.

29. The wellbore of claim 28, wherein the housing comprises at least one seal, the housing configured to seat within the tubular.

30. The wellbore of claim 29, wherein the housing further comprises a pressure sensor to monitor upstream screen or filter plugging.

31. The wellbore of claim 25, wherein the housing further comprises a pressure sensor to monitor upstream screen or filter plugging.

32. The wellbore of claim 31, wherein pressure data from the pressure sensor is used to determine when the well screen or filter will be flushed.

33. The wellbore of claim 25, wherein the velocity fuse is normally open and comprises a spring-loaded poppet responsive to changes in pressure drop across the velocity fuse.

34. A method of forming a completion system within a wellbore, the method comprising:

installing a tubular within a borehole, installing a pump within the tubular, the pump having an inlet end and a discharge end and a driver operatively connected to the pump for driving the pump; and installing a flushable well screen or filter assembly for placement within the tubular, comprising: a well screen or filter having an inlet end and an outlet end; and a velocity fuse positioned downstream of the outlet end of the well screen or filter, the velocity fuse in fluid communication with the well screen or filter, wherein the velocity fuse is structured and arranged to back-flush the well screen or filter and maintain a column of fluid within the tubular in response to an increase in pressure drop across the velocity fuse.

35. The method of claim 34, further comprising installing one or more packers to isolate one or more production zones within the wellbore.

36. A method of producing hydrocarbons from a subterranean formation, the method comprising:

providing a borehole extending into a hydrocarbon-bearing zone of the formation;

installing a tubular into the borehole;

installing a flushable well screen or filter assembly for placement within the tubular, comprising: a well screen or filter having an inlet end and an outlet end; and a velocity fuse positioned downstream of the outlet end of the well screen or filter, the velocity fuse in fluid communication with the well screen or filter, wherein the velocity fuse is structured and arranged to back-flush the well screen or filter and maintain a column of fluid within the tubular in response to an increase in pressure drop across the velocity fuse; and producing a fluid comprising hydrocarbons.

37. The method of claim 36, further comprising the step of back-flushing the well screen or filter.

38. The method of claim 37, wherein the step of back-flushing the well screen or filter comprises:

a) removing a tubular hydraulic seal downstream of the velocity fuse;

b) providing a differential pressure across the velocity fuse to create a high-velocity stream of fluid to back-flush the well screen or filter;

c) removing debris from the well screen or filter;

d) closing the velocity fuse using the high-velocity fluid stream; and e) re-installing the tubular hydraulic seal upon closure of the velocity fuse.

* * * * *